US005475902A

United States Patent [19]

Rogers, Jr. et al.

[11] Patent Number: 5,475,902

[45] Date of Patent: Dec. 19, 1995

[54] BURIAL CASKET INCORPORATING CATHODIC PROTECTION

[75] Inventors: Maurice N. Rogers, Jr., Batesville; Thomas F. Heil, Greensburg; Christopher W. Foye, Oldenburg, all of Ind.

[73] Assignee: Batesville Casket Company, Inc., Batesville, Ind.

[21] Appl. No.: 305,081

[22] Filed: Sep. 13, 1994

[51] Int. Cl.[6] ..... A61G 17/00

[52] U.S. Cl. ..... 27/1; 27/6; 204/197

[58] Field of Search ..... 27/1, 3, 6, 35; 204/196, 197, 148

[56] References Cited

U.S. PATENT DOCUMENTS 2,974,389 3/1961 Tatum ..... 204/197

3,052,946 9/1962 Hillenbrand .

*Primary Examiner*—Carl D. Friedman
*Assistant Examiner*—Kien T. Nguyen
*Attorney, Agent, or Firm*—Wood, Herron & Evans

[57] ABSTRACT

A cathodic protection system for a burial casket comprises a sacrificial anode rod, nylon sleeves encircling the rod and metal straps positively positioned relative the sleeves and welded to the casket bottom. One of the sleeves encircles the resistor of the system. The lead of the resistor connected between the casket and strap is carried in a slot in the one sleeve. The strap includes a welding dimple and a dog-eared corner which traps the lead between the casket bottom and the strap during welding of the strap to the bottom.

13 Claims, 2 Drawing Sheets

BURIAL CASKET INCORPORATING CATHODIC PROTECTION

FIELD OF THE INVENTION

This invention relates generally to caskets, and more particularly to improvements in cathodic protection for metal, and in particular steel, caskets.

BACKGROUND OF THE INVENTION

Metal caskets, and in particular steel caskets, upon being buried are subject to the effects of ground water. Depending on the location of burial, the ground water may contain salt or other minerals. Exposure to such ground water provides a corrosive potential which becomes actual upon the deterioration of the casket finish and the ultimate exposure of the bare metal to the elements.

Caskets have been provided with protection against corrosion by electrically connecting a sacrificial anode to the casket, whereby the casket becomes the cathode of an electrolytic cell in the presence of ground water. This sacrificial anode may be made of zinc, aluminum, magnesium or any other metal of higher electromotive potential than that of the cathode (casket).

One prior solution aimed at providing cathodic protection to a burial casket is disclosed in Hillenbrand U.S. Pat. No. 3,052,946, for "Burial Casket," issued Sept. 11, 1962 and assigned to the assignee of the present invention, the entire substance of which is hereby incorporated by reference herein as if fully set forth in its entirety. In that patent, there is disclosed a sacrificial anode rod mounted in a groove or recess in the bottom of the casket. A metal yoke is attached to either end of the anode rod. The ends of the yokes are attached to the casket recess by soldering or welding. The anode rod is electrically insulated from the casket over its length by wrapping the rod with insulating tape. An electrical resistor has one lead connecting the resistor to the core wire of the anode rod, and another lead connecting the resistor to the yoke to provide electrical connection between the casket and anode rod and through the resistor. The resistor provides a resistance in the circuit of an electrode cell comprised of the exposed metal of the casket, the sacrificial anode and the ground water. The resistor controls and limits the current flow through the circuit and hence retards or limits the rate at which the sacrificial anode is consumed after activation of the cell by deterioration of the casket finish.

The resistor mounting has been one area of the cathodic protection system which limits the reliability of the system. Specifically, the resistor, being somewhat delicately attached to the anode rod and casket, is subject to becoming snagged and pulled loose from the connection to the anode rod, the connection to the casket, or both, during fabrication, transport and the like of the casket. In addition, the resistor is subject to shorting if its leads come into contact with the casket bottom or the metal straps which are sometimes used to attach the anode rod to the casket bottom.

One prior attempt at improving the reliability of the casket cathodic protection system by protecting the resistor from damage has been to provide the steel strap which secures to the casket bottom the end of the anode rod, having the resistor attached, with a protecting tab portion which extends laterally from the bracket. The protecting tab portion extends over the resistor thus providing protection to the resistor from obstacles below the casket. The underneath, or resistor facing, side of the protecting tab is provided with insulative tape to prevent the resistor leads from shorting against the protecting tab portion of the steel strap. However, such a protection measure does not provide any protection to the resistor against its leads becoming forced against the bottom of the casket, and thereby shorting the resistor out. In addition, application of the insulating tape to the protective tab portion is somewhat difficult and cumbersome, and if the tape becomes nicked the bare metal of the protective tab portion can become exposed to the resistor leads thus presenting the possibility of shorting.

Another area of such casket cathodic protection systems which limits their reliability is the method of insulating the anode rod from the bottom of the casket and from the aforementioned metal straps sometimes used to attach the anode rod to the casket bottom. Such has taken the form of wrapping the anode rod with insulating tape. As discussed above, while not only being somewhat difficult and cumbersome to apply, the insulating tape has a tendency to become nicked thus exposing the anode rod to the casket bottom and/or the metal straps. Such nicks leave the anode rod susceptible to being shorted out at those points which leads to premature consumption of the anode rod.

It is therefore a main objective of the present invention to provide a cathodic protection system for a burial casket with improved reliability.

It is another objective of the present invention to provide for improved protection of the resistor element in a burial casket cathodic protection system.

It is yet another objective of the present invention to provide an improved means of insulating the anode rod and resistor from shorting out in a burial casket cathodic protection system.

SUMMARY OF THE INVENTION

The present invention attains the stated objectives by providing, in a metal burial casket having a body portion and a top portion sealable to the body portion, cathodic protection for inhibiting corrosion of the casket upon exposure to ground water. The cathodic protection comprises a sacrificial anode rod, an electrical connection between the anode rod and the body portion of the casket, an insulator disposed over the anode rod and including a protuberance projecting therefrom, and a metal strap weldable to the body portion of the casket which secures the insulator to the body portion, the strap having an aperture adapted to receive therein the protuberance of the insulator thereby locating the strap relative to the insulator during assembly to insure that the strap does not contact the anode rod. The protuberance is preferably an oval shaped pad and the aperture is preferably an oval shaped through hole.

In another aspect of the present invention, a metal burial casket is provided with cathodic protection comprising a sacrificial anode rod, an electrical connection between the anode rod and the body portion of the casket and including a lead having one end electrically connected to the anode rod and the other end connectable to the body portion of the casket, an insulator disposed over the anode rod adjacent the lead, and a metal strap weldable to the body portion of the casket which secures the insulator to the body portion, the strap including on one end a pair of projections extending out of the plane of the end of the strap, the projections providing a convenient means for retaining the other lead end between the strap and body portion during welding of the strap to the body portion and preventing the other lead end from slipping from between the strap and body portion.

The projections preferably comprise a dimple for welding the strap to the body portion and a dog-eared corner portion spaced from the dimple.

In yet another aspect of the present invention, a metal burial casket is provided with cathodic protection comprising a sacrificial anode rod, an electrical connection between the anode rod and the body portion of the casket and including a resistor having a pair of leads one of which electrically connects the resistor to the anode rod the other of which electrically connects the resistor to the body portion of the casket, an insulating sleeve placed over the anode rod and the resistor, encircling the resistor, the sleeve insulating the resistor from contacting the body portion on one side of the resistor and protecting the resistor from becoming snagged during fabrication, transport and the like of the casket on the other side of the resistor, and a metal strap weldable to the body portion of the casket which secures the sleeve to the body portion, the other resistor lead being positioned between the strap and the body portion.

In still another aspect of the present invention, a metal burial casket is provided with cathodic protection comprising a sacrificial anode rod, an electrical connection between the anode rod and the body portion of the casket and including a lead having one end electrically connected to the anode rod and the other end connectable to the body portion of the casket, an insulating sleeve placed over the anode rod adjacent the lead, the sleeve including a slot therein projecting from one end inwardly partially the length of the sleeve, the slot receiving therethrough the other end of the lead, and a metal strap weldable to the body portion of the casket which secures the sleeve to the body portion, the other lead end being positioned between the strap and the body portion.

In a preferred form of the present invention, a metal burial casket is provided with cathodic protection comprising a sacrificial anode rod having two ends, an electrical connection between the anode rod and the body portion of the casket, a pair of insulating sleeves one of which is placed over each end of the anode rod, each sleeve including a protuberance projecting therefrom, and a pair of metal straps weldable to the body portion of the casket one of which secures each sleeve to the body portion, each strap having an aperture adapted to receive therein the protuberance of a respective one of the sleeves thereby locating the strap relative to the sleeve during assembly to insure that the strap does not contact the anode rod.

The cathodic protection further preferably comprises a third insulating sleeve placed over the anode rod intermediate the rod ends, the third sleeve including the aforementioned protuberance, and a metal strap weldable to the body portion of the casket which secures the third sleeve to the body portion, the strap having the aforementioned aperture to thereby locate the strap relative to the third sleeve during assembly to insure that the strap does not contact the anode rod.

The sleeves are preferably fabricated of nylon.

The cathodic protection still further preferably comprises a resistor forming a part of the electrical connection between the anode rod and the body portion of the casket, with one of the sleeves encircling the resistor, the one sleeve insulating the resistor from contacting the body portion on one side of the resistor and protecting the resistor from becoming snagged during fabrication, transport and the like of the casket on the other side of the resistor.

Yet further preferably, the resistor has a pair of leads one of which electrically connects the resistor to the anode rod the other of which connects the resistor to the body portion of the casket. The one sleeve preferably includes a slot therein projecting from one end inwardly partially the length of the sleeve, the slot receiving therethrough the other resistor lead.

Still further preferably, the strap securing the one sleeve to the body portion includes on one end a dimple for welding the strap to the body portion and a dog-eared corner portion spaced from the dimple, the dimple and dog-eared corner portion providing a convenient means for retaining the other resistor lead between the strap and body portion during welding of the strap to the body portion and preventing the other resistor lead from slipping from between the strap and body portion.

The body portion of the casket includes a bottom which is preferably provided with a lower surface including a recess therein for receiving the anode rod and further including three recesses each of which receives a respective one of the straps therein.

One advantage of the present invention is that a cathodic protection system for a burial casket is provided which has improved reliability.

Another advantage of the present invention is that a cathodic protection system for a burial casket is provided which includes a series of nylon insulating sleeves spaced the length of the anode rod each of which has a positive connection to a steel attaching strap which attaches the anode rod to the bottom of the casket, thus avoiding the use of insulating tape about the anode rod and associated difficulties thereof and insuring that the strap will not inadvertently contact the anode rod during assembly. The sleeves thus provide insulation for the anode rod against contacting the casket bottom and the metal attaching straps.

Yet another advantage of the present invention is that a cathodic protection system for a burial casket is provided which includes a metal strap having a welding dimple and a dog-eared corner portion which cooperate to provide a convenient means of retaining the lead of the anode rod between the strap and the body portion of the casket during welding of the strap to the body portion.

Still another advantage of the present invention is that a cathodic protection system for a burial casket is provided which provides increased protection for the resistor element of the system, on both the upper and lower sides of the resistor, and further for the lead of the resistor connecting the resistor to the casket.

These and other objects and advantages of the present invention will become more readily apparent during the following detailed description taken in conjunction with the drawings herein, in which:

DETAILED DESCRIPTION OF THE INVENTION

Figure 1:
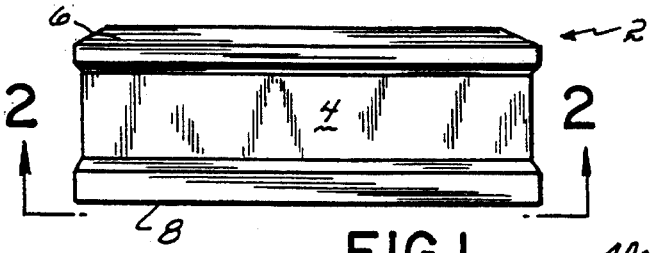
FIG. 1 is a side elevational view of a burial casket employing the principles of the present invention.

Referring first to FIG. 1, a metal, for example mild steel or stainless steel, casket 2 includes a body portion 4 and a top portion 6 sealable to the body portion 4. Body portion 4 includes a bottom 8.

Referring now to FIGS. 2–11, and initially to FIGS. 2–5, bottom 8 includes an elongated semi-circular recess or groove 10. Near either end of the groove 10, a transverse groove or recess 12 is located. In the center of the groove 10, a third groove or recess 14 is located. Recesses 12 and 14 are not as deep as the recess 10.

Within the recess 10, there is located a sacrificial anode 16 in the form of an elongated rod or bar. Anode rod 16 is semi-circular in cross section and fits within the semi-circular recess 10 essentially flush with the bottom 8 of the casket 2.

Referring now to FIGS. 2–7, anode rod 16 comprises the magnesium alloy rod portion 18 and a centrally located wire core 20 fabricated of a ferrite material which runs the full length of the rod portion 18 interiorally of the rod portion 18. Wire core 20 provides an enduring electrical connection which extends over the entire length of the anode rod 16 to avoid segregation by corrosion of portions of the anode rod 16.

One end 22 of wire 20 is provided with a copper ferrule 24. A resistor 26 has one lead 28 connected to the ferrule 24 and hence the wire 20 as by crimping and potting with epoxy, and another lead 30 which is connected between the recess 12 and a mild steel connecting strap 32. For mild steel caskets, resistor 26 is a 50 ohm 2 watt resistor. For stainless steel caskets, resistor 26 is a 72 ohm 2 watt resistor. Anode rod 16 is purchased from Dow Chemical Company as Part No. 40400350.

Referring to FIGS. 2–8, connecting strap 32 includes two ends 34 each of which includes a welding dimple 36 and a dog-eared corner portion 38. Welding dimples 36 are for spot welding the strap 32 to the bottom 8 of the body portion 4 of the casket 2. Dog-eared corner portions 38 are provided in strap 32 so that lead 30 of resistor 26 may be conveniently trapped between dimple 36 and dog-eared corner portion 38 on one end 34 of the strap 32 to serve as a convenient means of trapping the lead 30 underneath the strap 32 and between the strap 32 and bottom 8 of the body portion 4 during welding of the strap 32 to the bottom 8.

Referring to FIGS. 2–7, 9 and 10, a pair of end sleeves 40, preferably fabricated of 6/6 nylon, though other thermoset plastics such as polyester, polypropylene, polycarbonate etc. may be employed, are slipped over the ends of the anode rod 16. Each end sleeve 40 includes a semi-circular portion **40*a* and a flat portion 40*b* and further includes a protuberance 42 in the nature of an oval pad on the flat portion 40*b*. An oval aperture 44 is located in the strap 32 and is adapted to accept the pad 42 therethrough. Thus, when assembling the anode rod 16 into the recess 10, the strap 32 may be positively located relative to the insulating sleeve 40, thus avoiding the strap 32 from coming inadvertently into contact with the anode rod 16 thus shorting the rod 16**.

Figure 6:
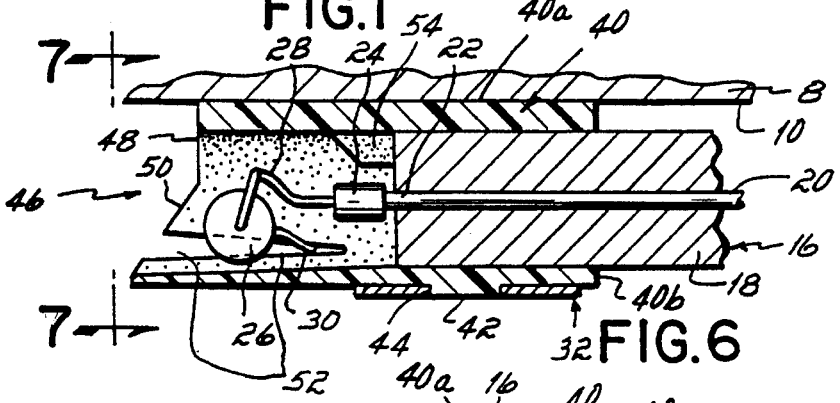
FIG. 6 is a view taken along line 6—6 of FIG. 3.
Figure 7:
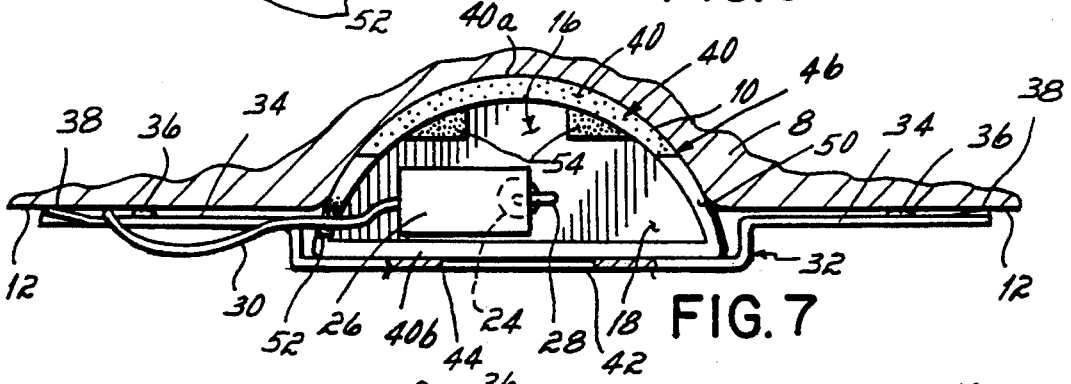
FIG. 7 is a view taken along line 7—7 of FIG. 6.
Figure 8:
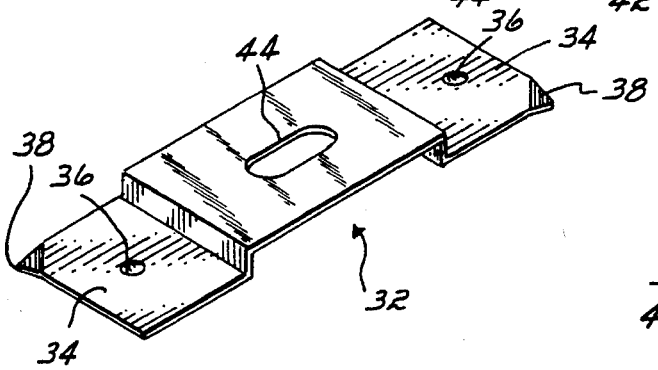
FIG. 8 is a perspective view of a strap according to the principles of the present invention.
Figure 9:
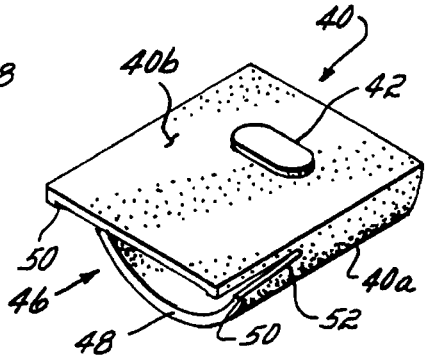
FIG. 9 is a bottom perspective view of an end sleeve according to the principles of the present invention.
Figure 10:
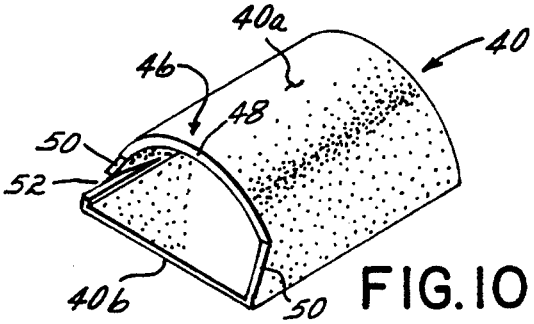
FIG. 10 is a top perspective view of the sleeve of FIG. 9.
Figure 2:
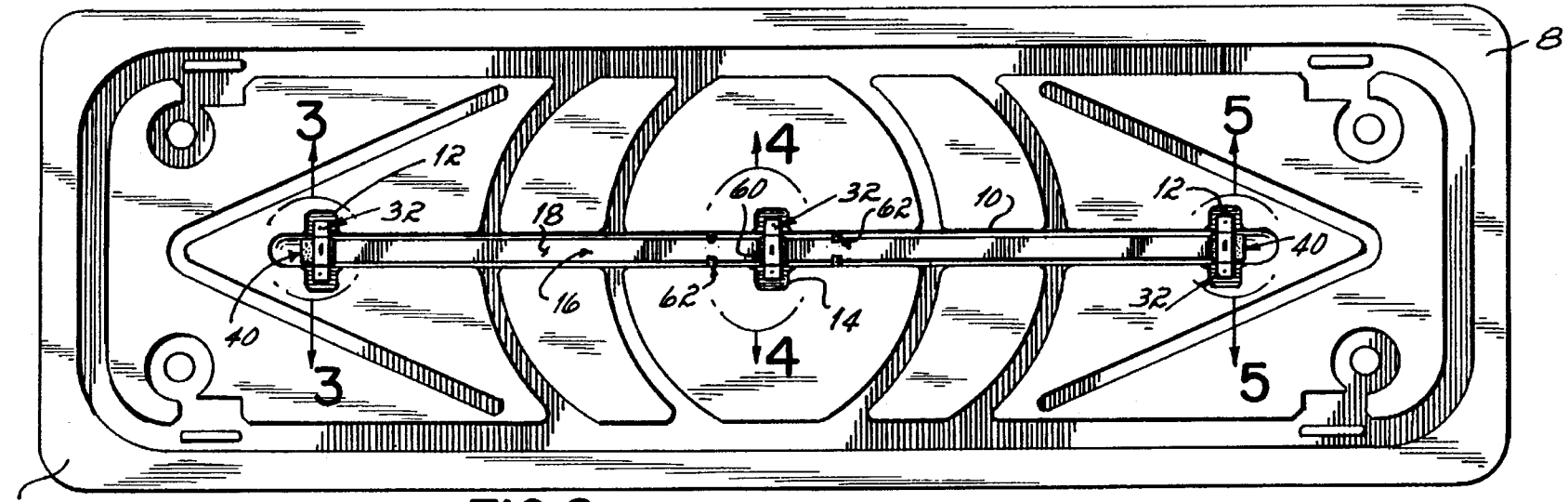
FIG. 2 is a bottom view taken along line 2—2 of FIG. 1.
Figure 5:
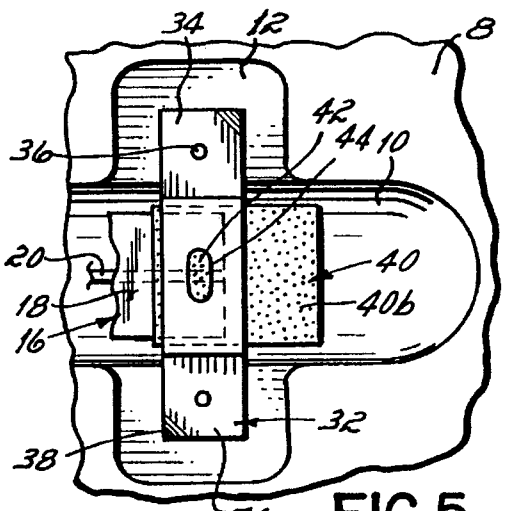
FIG. 5 is the encircled area 5—5 of FIG. 2, greatly enlarged.

Referring in particular to FIGS. 6, 7, 9 and 10, each end sleeve 40 includes an end 46 including a vertical cut 48 and an angled cut 50. The cuts 48 and 50 allow for easy manipulation of the resistor 26 and its lead 30. Resistor 26, during installation, is oriented generally transverse to the sleeve 40 so that the resistor 26 is completely encircled by the sleeve 40. In the end 46 of the sleeve 40 there is an inwardly extending notch 52. Lead 30 of resistor 26 is placed within notch 52 prior to being positioned between strap 32 and bottom 8 of body portion 4. Notch 52 provides a convenient means of locating, isolating and protecting lead 30 of resistor 26. The combination of resistor encircling sleeve 40 with notch 52 insulates the resistor 26 on both its upper and lower sides, and reduces the tendency of the resistor 26 and its leads 28 and 30 from becoming snagged, etc. during fabrication, transport and the like of the casket 2. Referring in particular to FIGS. 6 and 7, each end sleeve 40 includes a pair of tabs 54 which locate the sleeve 40 relative to the end of the anode bar 16. Sleeve 40 is simply placed over the end of the bar 16 and advanced over the bar 16 until the tabs 54 contact the end surface 56 of the bar 16.

Figure 4:
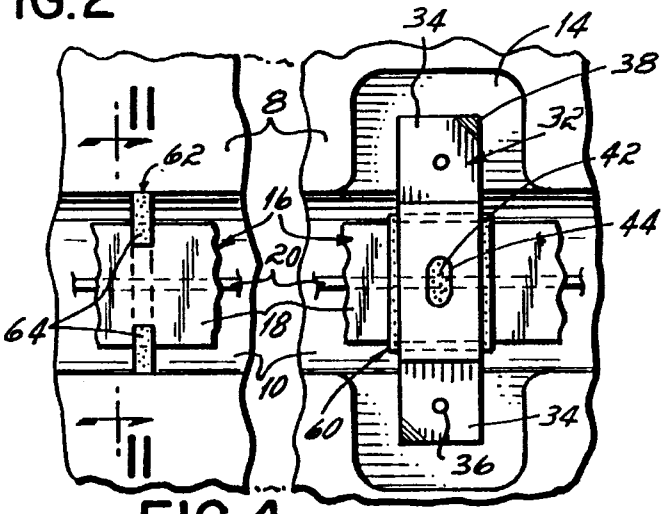
FIG. 4 is the encircled area 4—4 of FIG. 2, greatly enlarged.
Figure 3:
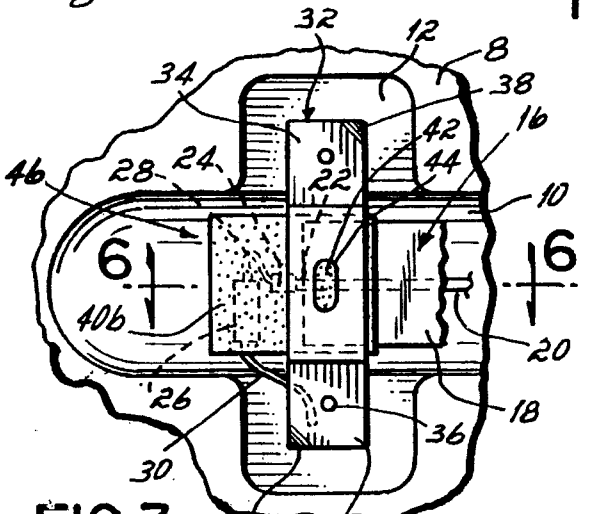
FIG. 3 is the encircled area 3—3 of FIG. 2, greatly enlarged.

Referring now to FIG. 4, a third sleeve 60 is positioned intermediate the ends of the rod 16. Sleeve 60, like the sleeves 40, is fabricated of 6/6 nylon though other thermoset plastics may be employed, includes a semi-circular portion and a flat portion, and preferably includes a longtiduinally oriented slot (not shown) extending entirely across the sleeve 60 to allow the sleeve to be snapped over the bar 16 at its center, rather than having to slip the sleeve 60 on one end of the rod 16 and then slide the sleeve 60 all the way to the middle of the rod 16. The sleeve 16 includes one of the aforementioned protuberances 42. One of the aforementioned straps 32 secures this sleeve to the bottom 8 of the casket body 4. Again, the strap 32 is positively located with the sleeve 60 thereby avoiding inadvertent contact of the strap 32 with rod 16.

Figure 11:
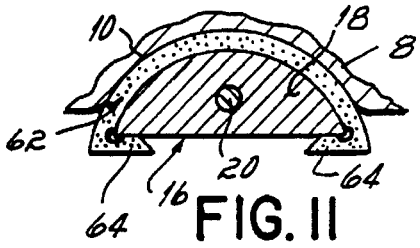
FIG. 11 is a view taken along line 11—11 of FIG. 4.

Lastly, and referring to FIGS. 4 and 11, clips 62, likewise preferably fabricated of 6/6 nylon though other thermoset plastics may be employed, semi-circular in shape and including inwardly directed feet 64, are snapped over the anode rod 16 between the center sleeve 60 and each end sleeve 40. Clips 62 serve as additional insulative stand offs between the anode rod 16 and the recess 10 of the bottom 8 of body portion 4.

In use of the present invention, the invention provides a number of advantages during assembly of a cathodic protection system to a casket and which extends the reliability and hence life of the cathodic protection system. One need not wrap tape around the anode rod to insulate the anode rod. Rather, nylon sleeves which are much more durable than insulating tape are slipped over the rod, and straps are placed over the sleeves and are welded to the bottom of the casket. The straps are positively located with respect to the sleeves so that no contact between strap and anode rod occurs. The end sleeve on the end of the anode rod which includes the resistor extends away from the end of the anode rod thus encircling and protecting the resistor. The resistor lead which is welded between the strap and casket bottom is captured in a slot in the sleeve thus protecting it as well. Further, that lead is conveniently trapped between the welding dimple and dog-eared corner of the strap during welding of the strap to the bottom thus preventing that lead from inadvertently slipping out from between the strap and the bottom.

Those skilled in the art will readily recognize numerous adaptations and modifications which can be made to the present invention which will result in an improved cathodic protection system for a burial casket, yet all of which will fall within the spirit and scope of the present invention as defined in the following claims. Accordingly, the invention is to be limited only by the scope of the following claims and their equivalents.

What is claimed is:

1. A metal burial casket having a body portion and a top portion sealable to said body portion, said casket including cathodic protection for inhibiting corrosion of said casket upon exposure to ground water, said cathodic protection comprising:

a sacrificial anode rod;

an electrical connection between said anode rod and said body portion of said casket;

an insulator disposed over said anode rod and including a protuberance projecting therefrom; and a metal strap welded to said body portion of said casket which secures said insulator to said body portion, said strap having an aperture received therein said protuberance of said insulator thereby locating said strap relative to said insulator during assembly thereof to insure that said strap does not contact said anode rod.

2. The casket of claim 1 wherein said protuberance is an oval-shaped pad and said aperture is an oval-shaped through hole.

3. A metal burial casket having a body portion and a top portion sealable to said body portion, said casket including cathodic protection for inhibiting corrosion of said casket upon exposure to ground water, said cathodic protection comprising:

a sacrificial anode rod;

an electrical connection between said anode rod and said body portion of said casket and including a lead having one end electrically connected to said anode rod and the other end connected to said body portion of said casket;

an insulator disposed over said anode rod adjacent said lead; and a metal strap welded to said body portion of said casket which secures said insulator to said body portion, said strap including on one end a pair of projections extending out of the plane of said end of said strap, said projections providing a convenient means for retaining said other lead end between said strap and body portion during welding of said strap to said body portion and preventing said other lead end from slipping from between said strap and body portion.

4. The casket of claim 3 wherein said projections comprise:

a dimple for welding said strap to said body portion and a dog-eared corner portion spaced from said dimple.

5. A metal burial casket having a body portion and a top portion sealable to said body portion, said casket including cathodic protection for inhibiting corrosion of said casket upon exposure to ground water, said cathodic protection comprising:

a sacrificial anode rod;

an electrical connection between said anode rod and said body portion of said casket and including a resistor having a pair of leads one of which electrically connects said resistor to said anode rod the other of which electrically connects said resistor to said body portion of said casket;

an insulating sleeve placed over said anode rod and said resistor, encircling said resistor, said sleeve insulating said resistor from contacting said body portion on one side of said resistor and protecting said resistor from becoming snagged during fabrication, transport and the like of said casket on the other side of said resistor; and a metal strap welded to said body portion of said casket which secures said sleeve to said body portion, said other resistor lead being positioned between said strap and said body portion.

6. A metal burial casket having a body portion and a top portion sealable to said body portion, said casket including cathodic protection for inhibiting corrosion of said casket upon exposure to ground water, said cathodic protection comprising:

a sacrificial anode rod;

an electrical connection between said anode rod and said body portion of said casket and including a lead having one end electrically connected to said anode rod and the other end connected to said body portion of said casket;

an insulating sleeve placed over said anode rod adjacent said lead, said sleeve including a slot therein projecting from one end inwardly partially the length of said sleeve, said slot receiving therethrough said other end of said lead; and a metal strap welded to said body portion of said casket which secures said sleeve to said body portion, said other lead end being positioned between said strap and said body portion.

7. A metal burial casket having a body portion and a top portion sealable to said body portions, said casket including cathodic protection for inhibiting corrosion of said casket upon exposure to ground water, said cathodic protection comprising:

a sacrificial anode rod having two ends;

an electrical connection between said anode rod and said body portion of said casket;

a pair of insulating sleeves one of which is placed over each said end of said anode rod, each said sleeve including a protuberance projecting therefrom; and a pair of metal straps welded to said body portion of said casket one of which secures each said sleeve to said body portion, each said strap having an aperture received therein said protuberance of a respective one of said sleeves thereby locating said strap relative to said sleeve during assembly thereof to insure that said strap does not contact said anode rod.

8. The casket of claim 7 further comprising:

a third insulating sleeve placed over said anode rod intermediate said rod ends, said third sleeve including a protuberance projecting therefrom; and a metal strap welded to said body portion of said casket which secures said third sleeve to said body portion, said strap having an aperture received therein said protuberance of said third sleeve thereby locating said strap relative to said third sleeve during assembly thereof to insure that said strap does not contact said anode rod.

9. The casket of claim 8 wherein said sleeves are fabricated of nylon.

10. The casket of claim 8 wherein said body portion of said casket includes a bottom having a lower surface, said lower surface including a recess therein for receiving said anode rod and further including three recesses each of which receives a respective one of said straps therein.

11. The casket of claim 7 further comprising:

a resistor forming a part of said electrical connection between said anode rod and said body portion of said casket;

one of said sleeves encircling said resistor, said one sleeve insulating said resistor from contacting said body portion on one side of said resistor and protecting said resistor from becoming snagged during fabrication, transport and the like of said casket on the other side of said resistor.

12. The casket of claim 11 wherein:

said resistor has a pair of leads one of which electrically connects said resistor to said anode rod the other of which connects said resistor to said body portion of said casket; and said one sleeve includes a slot therein projecting from one end inwardly partially the length of said sleeve, said slot receiving therethrough said other resistor lead.

13. The casket of claim 12 wherein said strap securing said one sleeve to said body portion includes on one end a dimple for welding said strap to said body portion and a dog-eared corner portion spaced from said dimple, said dimple and dog-eared corner portion providing a convenient means for retaining said other resistor lead between said strap and body portion during welding of said strap to said body portion and preventing said other resistor lead from slipping from between said strap and body portion.

* * * * *